US008596067B2

(12) United States Patent
Conard et al.

(10) Patent No.: US 8,596,067 B2
(45) Date of Patent: Dec. 3, 2013

(54) COOLING TOWER APPARATUS AND METHOD WITH WASTE HEAT UTILIZATION

(75) Inventors: Spencer D Conard, Charlotte, NC (US); Glenn S Brenneke, Lee's Summit, MO (US); Eldon F Mockry, Lenexa, KS (US)

(73) Assignee: SPX Corporation, Charlotte, NC (US)

( * ) Notice: Subject to any disclaimer, the term of this patent is extended or adjusted under 35 U.S.C. 154(b) by 642 days.

(21) Appl. No.: 12/610,743

(22) Filed: Nov. 2, 2009

(65) Prior Publication Data

US 2010/0154406 A1 Jun. 24, 2010

Related U.S. Application Data

(60) Provisional application No. 61/139,399, filed on Dec. 19, 2008, provisional application No. 61/149,614, filed on Feb. 3, 2009.

(51) Int. Cl.

| | |
|---|---|
| ***F01K 25/08*** | (2006.01) |
| ***F01K 7/34*** | (2006.01) |
| ***F01K 25/00*** | (2006.01) |
| ***F01K 7/22*** | (2006.01) |

(52) U.S. Cl.
USPC ..... 60/651; 60/653; 60/671; 60/679

(58) Field of Classification Search
USPC ..... 60/641, 645–681, 682, 684
See application file for complete search history.

(56) References Cited

U.S. PATENT DOCUMENTS

| | | | | |
|---|---|---|---|---|
| 3,841,099 | A * | 10/1974 | Somekh | 60/671 |
| 4,360,569 | A | 11/1982 | Steyert et al. | |
| 4,402,187 | A | 9/1983 | Golben et al. | 62/48 |
| 4,443,389 | A * | 4/1984 | Dodds | 261/153 |
| 4,576,005 | A | 3/1986 | Force | |
| 4,580,401 | A | 4/1986 | Ruscheweyh | 60/693 |
| 4,742,682 | A * | 5/1988 | Assaf et al. | 60/641.1 |
| 4,996,841 | A | 3/1991 | Meijer et al. | |
| 5,227,095 | A | 7/1993 | Curtis | |
| 5,644,608 | A * | 7/1997 | Malik et al. | 376/272 |
| 6,672,048 | B2 * | 1/2004 | Johnstone | 60/39.35 |
| 7,062,913 | B2 * | 6/2006 | Christensen et al. | 60/651 |
| 2006/0112693 | A1 * | 6/2006 | Sundel | 60/670 |
| 2008/0289335 | A1 * | 11/2008 | Drysdale | 60/649 |

OTHER PUBLICATIONS

John C Hensley, Cooling Tower Fundamentals, Second Edition, p. 11, Publised by SPX Cooling Technologies, 2009.*

Unconventional working fluids in organic Rankine-cycles for waste energy recovery systems, Maizza et al. Applied Thermal Engineering 21 (2001) 381-390.*

* cited by examiner

*Primary Examiner* — Kenneth Bomberg
*Assistant Examiner* — Deming Wan
(74) *Attorney, Agent, or Firm* — Baker & Hostetler LLP

(57) ABSTRACT

A cooling tower system is provided that can exhibit increased energy efficiency. The cooling tower system includes a cooling tower unit, an expansion engine and a power operated component such as a fan or pump. The process fluid is first used to heat a working fluid for an expansion engine before being sent to the cooling tower for cooling. Power generated by the expansion engine is utilized to operate a component of the cooling tower such as a fan or a pump. The cooling tower is also utilized to provide cooling to condense the working fluid from a vapor to a liquid form cooling tower is used to remove waste heat from a process fluid.

42 Claims, 8 Drawing Sheets

COOLING TOWER APPARATUS AND METHOD WITH WASTE HEAT UTILIZATION

CLAIM FOR PRIORITY

The present application is a non-provisional application that claims priority to U.S. Provisional Patent Application No. 61/139,399, filed Dec. 19, 2008, entitled Cooling Tower Apparatus and Method with Waste Heat Utilization and U.S. Provisional Patent Application No. 61/149,614, filed Feb. 3, 2009, entitled Cooling Tower Apparatus and Method with Waste Heat Utilization, each of the disclosures of which is hereby incorporated by reference in its entirety.

FIELD OF THE INVENTION

The invention pertains generally to cooling tower systems such as atmospheric cooling towers which are used to cool a relatively warm or hot fluid by circulating the fluid through the tower using ambient air to cool the fluid. Some embodiments of the present invention also pertain to energy systems used in conjunction with such cooling towers.

BACKGROUND OF THE INVENTION

Atmospheric cooling towers are in wide use in industry. These towers receive a relatively warm or hot fluid, and pass the fluid through the tower apparatus so that heat is extracted from the fluid by interaction with relatively cooler ambient air. In some instances, the fluid entering the tower is a process fluid that has been heated by an industrial operation. Also, in some instances, intermediate fluid loops with heat exchangers are used in between the originally hot process fluid and the other fluid actually circulated through the tower.

Industrial cooling towers come in a wide variety of types including, by way of example only, splash bar type wet cooling towers, fill pack type wet cooling towers, dry cooling towers, hybrid wet/dry cooling towers, and dry air cooled condensers. The cooling towers often are designed such that they require a supply of electrical energy or other work energy to drive mechanical systems such as fans and/or pumps which may be present.

Additionally, waste heat expansion engines are known for generating power from exit fluid from power plants, and can require a cooling system such as a cooling tower for condensing the working fluid used in the heat engine. Such expansion engines are also interchangeably referred to herein as waste heat expansion engines or waste heat engines. It is also known to use heat from solar ponds to drive expansion engines and to use cooling towers to cool the expansion engine working fluid in that context.

It would be desirable to reduce the energy consumption of cooling towers, and hence improve the energy efficiency of the towers.

SUMMARY OF THE INVENTION

The present invention in some embodiments relates to a method for operating a cooling tower system for cooling a heated process fluid, which has a component that requires power for operation and has an expansion engine. The expansion engine supplies a process fluid to a heat exchanger to heat a working fluid passing through the heat exchanger, and generating power by expansion of the heated working fluid, which provides generated power from the expansion engine to the component for operation thereof. The process utilizes the cooling tower to cool the working fluid from the expansion engine and to cool the process fluid after it has passed through the heat exchanger.

Some further embodiments of the present invention include a cooling tower system for cooling a supply of fluid to be cooled, which has a cooling tower unit having a component that requires power for operation, and a waste heat engine that generates power from heat transfer from the fluid to provide at least some of the power required to operate the component.

Yet another embodiment involves a cooling tower system for cooling a power plant fluid with an elevated temperature, having a component to be powered. The system has power generation means for generating power from waste heat from said fluid, which includes a working fluid that expands to form an expanded vapor. The system also has means for providing the power to the component, and cooling means for cooling the power plant fluid and condensing the expanded vapor working fluid into a liquid form.

Further embodiments provide a method for operation of a cooling tower. An expansion engine is connected to the cooling tower for providing power to a fan of the tower. A working fluid circuit is provided in communication with the expansion engine. The working fluid is heated in the circuit with heat from an exit fluid of the power plant and the heated working fluid is expanded in the expansion engine to generate power for powering the fan. The working fluid is in the form of a vapor upon exit from the expansion engine. The cooling tower is utilized to remove heat from the working fluid vapor to condense the working fluid into a liquid form, and cools the exit fluid from the power plant after the exit fluid has been utilized to heat the working fluid.

Another embodiment provides an operating method for a cooling tower system at a power plant having a component that requires power for operation and an expansion engine. Heat is exchanged from a waste heat fluid from the power plant to a working fluid. The heated working fluid is expanded in the expansion engine to generate power. The generated power from the expansion engine is provided to the component for operation thereof. The cooling tower is utilized to cool the working fluid from the expansion engine and to cool the waste heat fluid after it has heated the working fluid.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
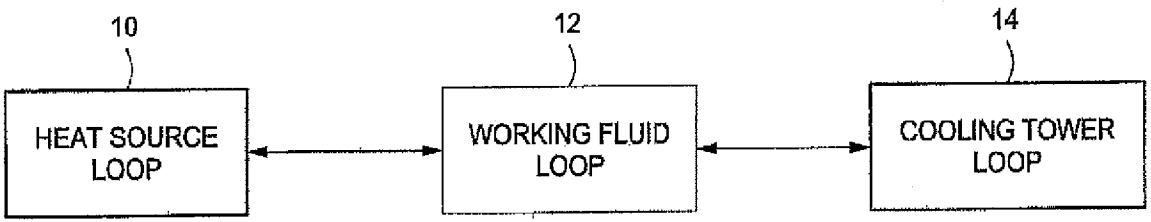
FIG. 1 is a schematic diagram of a system according to a preferred embodiment of the invention.

Some embodiments of the present invention provide for combining an expansion engine with a cooling tower at a power plant (or other additional process plants) to achieve both (i) cooling for the plant exit fluid (for example, steam or hot water), and/or (ii) cooling for condensation of the expanded working fluid of the expansion engine. This can provide efficiency in the operating energy consumption of the cooling tower by utilizing waste heat from the exit fluid of the power plant. The waste heat is converted by a heat engine into electrical energy or mechanical work energy which can be used to supply power to some or all of the cooling tower components, such as fans and/or pumps. Examples of some preferred embodiments will now be described with reference to the drawing figures, in which like reference numbers refer to like parts throughout.

FIG. 1 is a basic diagram of an exemplary embodiment of the present invention. A heat source loop 10 is thermally connected to a working fluid loop 12. The working fluid loop 12 is thermally connected to a cooling tower fluid loop 14.

Figure 2:
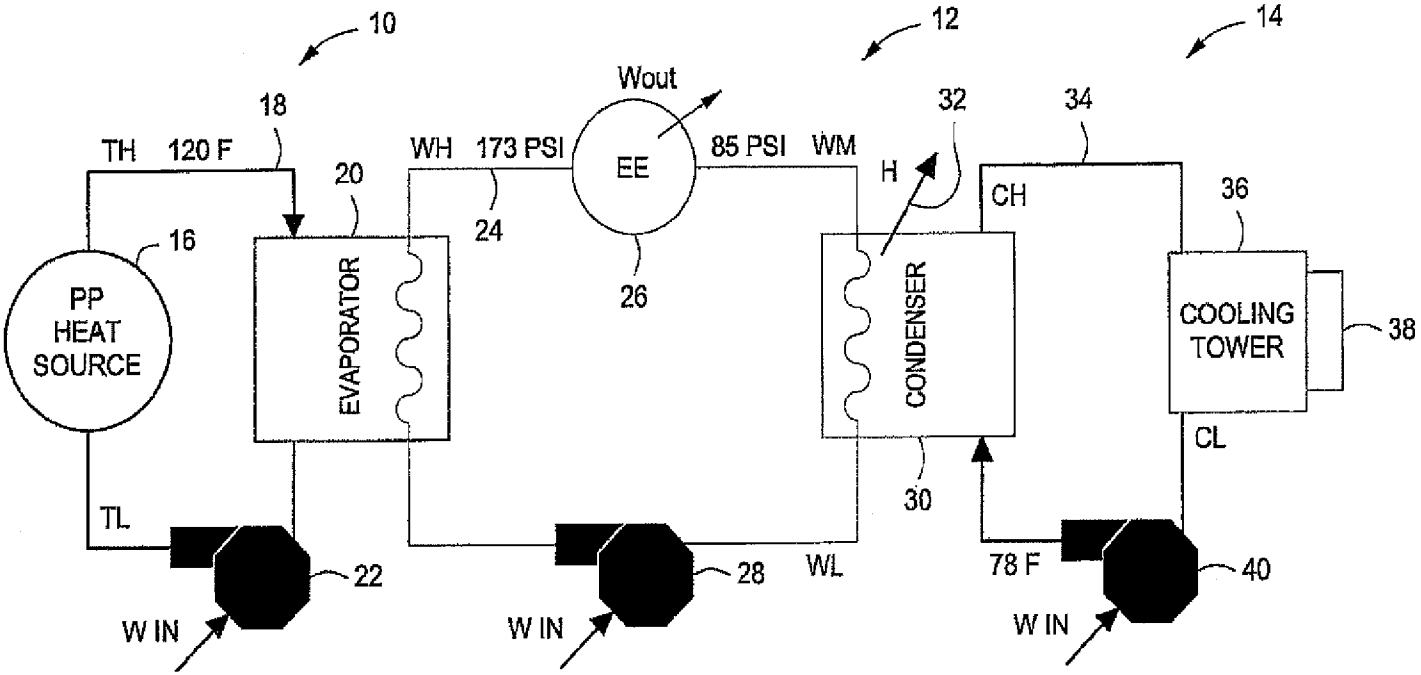
FIG. 2 is a more detailed diagram of an example of a system according to FIG. 1.

FIG. 2 shows an example of a system according to FIG. 1 in more detail. The heat source loop 10 includes a power plant or heat source 16. The power plant can be any type of system or apparatus that produces heat. The words power plant, process plant and heat source are used interchangeably herein. Examples of such power plants include electric power generation plants, steels mills, pulp and paper process plants, manufacturing facilities, semiconductor fabrication facilities, pharmaceutical process plants, petrochemical process plants, industrial facilities, refrigeration systems and HVAC systems. Those power plants may discharge hot fluids from equipment such as injection molding machines, air compressors, autoclaves, furnaces, mills, chillers, condensers, rollers, die casters, extruders, heat exchangers, oil coolers, welders, vacuum pumps, reactors and/or dehydration equipment.

The power plant 16 discharges hot fluid typically in the form of hot water or steam, into a conduit loop 18. Different power plants produce a wide range of different output temperatures, but some examples that may occur include 200° F. steam or 120° F. hot water. The exit temperature from the power plant is labeled as TH. This hot fluid is passed through an evaporator 20 and exits at a temperature TL which is lower than TH and the fluid at temperature TL is returned to the power plant. The heat source loop 10 may include some form of power operated devices such as a pump and this is illustrated by the component 22 which receives mechanical or electrical energy illustrated as Win.

The working fluid loop 12 begins at the evaporator 20 and is a closed loop system that circulates working fluid. The working fluid typically will be a refrigerant; however, any of various working fluids can be used with the system 10, and a suitable working fluid for a particular application of the system will involve considerations of environmental issues, flammability, toxicity, and the like. The selection can be made from several general classes of working fluids commonly used in refrigeration. A first general class is hydrocarbons, including propane (R290), isobutane (R600a), n-butane (R600), cyclopropane (RC270), ethane (R170), n-pentane (R601), and isopentane (R601a). A concern with this first class is the flammability of the compounds; on the other hand, they have no adverse effect on the earth's ozone layer, are not generally implicated in global warming, and have low environmental impacts in production. A second general class is chlorohydrocarbons (e.g., methyl chloride (R40)). A third general class is chlorofluorocarbons (e.g., trichlorofluoromethane (R11), dichlorodifluoromethane (R12), monofluorodichloromethane (R21), and monochlorodifluoromethane (R22), and trichlorotrifluoroethane (R113), as well as R114, R500, and R123 (or HCFC-123)). A concern with the second and third classes is the adverse effect of these compounds, when released into the environment, on the earth's ozone layer. A fourth general class is fluorohydrocarbons (e.g., tetrafluoroethane (R134a), pentafluoroethane (R125), R502, R407C, R410, and R417A, and HFE-7000). A fifth general class is other compounds such as ammonia (R717), sulfur dioxide (R764), and carbon dioxide. Benefits of the fluorohydrocarbons are their inertness and non-flammability. Some of these compounds currently have environmental and/or toxicity concerns associated with them. Another class of working fluids that may be advantageous for some uses is nanofluids, or liquids that contain dispersed nano-sized particles. Water, ethylene glycol, and lubricants can successfully be used as base fluids in making nanofluids. Carbon, meals, and metal oxides can serve as nanoparticles. In the evaporator 20, the relatively hot temperature TH from the process fluid heats and/or pressurizes the working fluid to a higher temperature and/or pressure condition WH at conduit 24. The relatively hot and/or high pressure working fluid is passed through a waste heat expansion engine EE 26, and is discharged from the waste heat expansion engine 26 at a lower temperature and/or pressure. The expansion engine provides mechanical or electrical work output illustrated by Wout. The working fluid exiting the expansion engine EE is at a reduced temperature and/or pressure WM and is passed to a condenser 30. The condenser 30 cools and condenses the working fluid to a low temperature and/or pressure WL, resulting in a heat output 32. The cooled and/or condensed working fluid is returned to the evaporator 20. An energy consuming system such as a pump 28 may be utilized to circulate the fluid, and this device can require mechanical or electrical energy illustrated by Win.

The cooling tower loop 14 receives relatively warm cooling fluid from the condenser 30 at a warm temperature CH and passes it via conduit 34 to the cooling tower 36. The cooling tower 36 may have a fan 38 and other associated mechanical systems such as a pump 40, both of which require some mechanical or electrical energy Win. The cooling tower fluid enters the cooling tower 36, where it is cooled in the cooling tower 36 by contact with ambient air, and exits the cooling tower at a lower temperature CL than it entered. The lower temperature cooling tower fluid is returned to the condenser 30 which further cools the working fluid.

In some embodiments, the evaporator 20 and/or the condenser 30 incorporate plate heat exchangers, including, for example, multi-plate, brazed, stainless steel heat exchangers.

Figure 3:
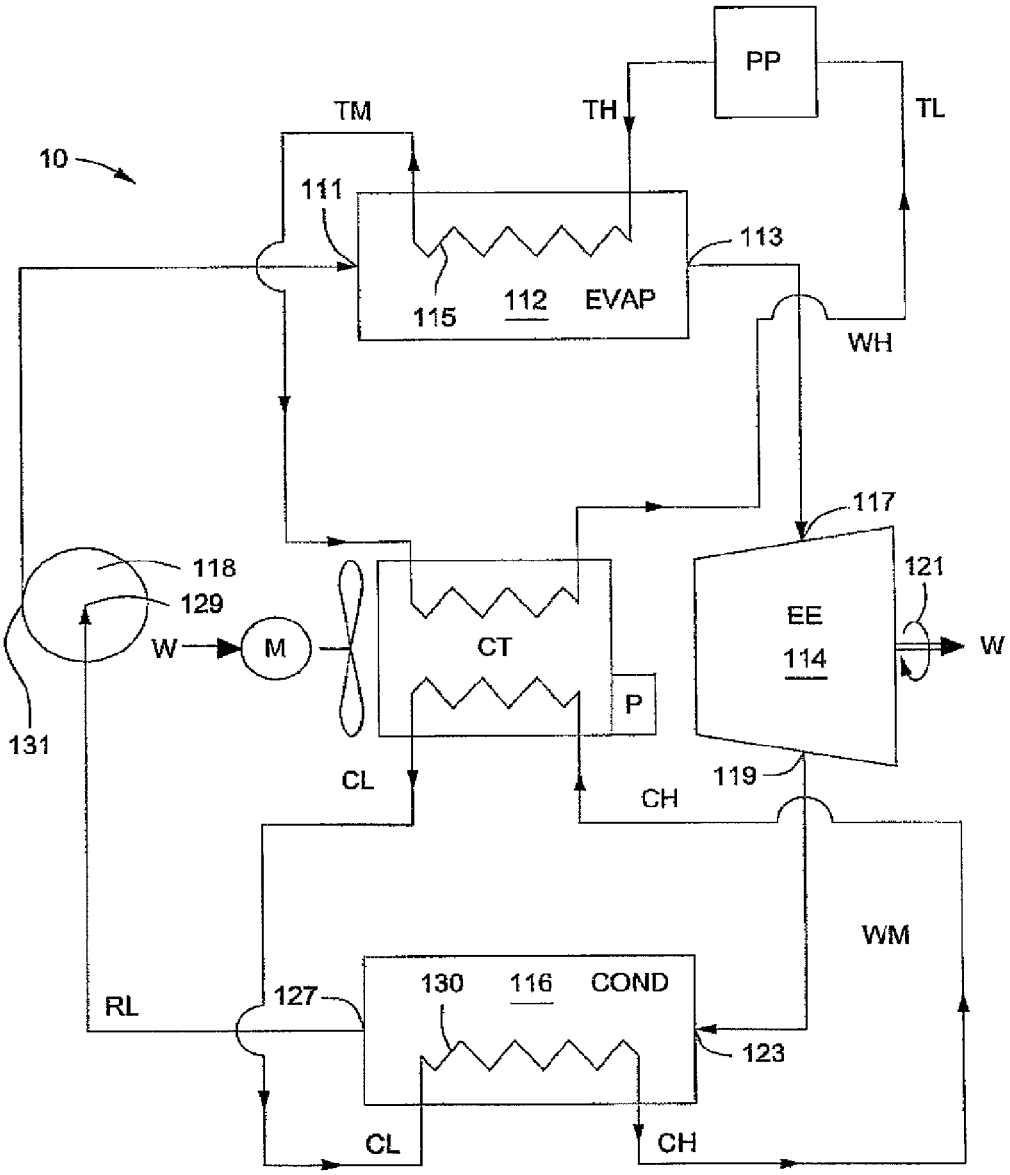
FIG. 3 is a diagram according to an exemplary embodiment.

Referring now to FIG. 3 , a heat loop 10 is depicted having an evaporator 112 having an inlet 111 and an outlet 113 and connected to receive a liquid working fluid and vaporizing said liquid to a vapor on input of heat from a heat source input such as a heat exchanger 115. The loop 10 further includes a positive displacement device 114 such as a rotating expander, e.g., a scroll or gerotor, used in expansion mode and an inlet 117 and outlet 119 adapted for receiving and expanding said vapor from said evaporator outlet 113 at high pressure to produce a work output 121 and providing said vapor at low pressure at said outlet 119. The loop 10 also comprises a condenser 116 having an inlet 123 for receiving said vapor from said expander outlet 119 and condensing said vapor back to a fluid liquid and a pump 118 with an inlet 129 and outlet 131 for taking the fluid liquid from condenser outlet 127 at low pressure and providing it to the inlet 111 at high pressure.

Moreover, FIG. 3 shows the adaptation of the system of U.S. Pat. No. 7,062,913 to a cooling tower CT. Specifically, the power plant PP generates hot process fluid at a temperature TH which is supplied to the evaporator 112. The process fluid exits the evaporator 112 at a medium temperature TM and is supplied to the cooling tower CT. The process fluid is cooled by the cooling tower and exits the cooling tower at a low temperature TL where it is returned to the power plant. Further, hot fluid CH from the condenser 116 is supplied to the cooling tower CT where it is cooled to a lower temperature CL, and it is returned to the condenser 116 at the lower temperature CL. This improves the efficiency of the condenser 116. The working fluid circulates as described in U.S. Pat. No. 7,062,913 and thus enters the device 114 at a hot working temperature from the evaporator and leaves the device 114 at a lower temperature WM. The device labeled 114 can in a preferred embodiment be a waste heat expansion engine, and thus can be any type of waste heat expansion engine, for example a rotary vane turbine such as a power steering pump, not merely the device disclosed in U.S. Pat. No. 7,062,913.

The work W generated by the waste heat expansion engine 114 is labeled as output 121. This work W can be supplied to the cooling tower to drive a fan motor M and/or pump P that may be associated with the cooling tower. The work can be supplied as rotational mechanical work by gears and/or a belt and pulleys or can be supplied as electricity by a generator.

There are a wide variety of examples of waste heat engines that may be utilized in some or all embodiments of the present invention. By way of example only, the heat engine can be an organic rankine engine, or a piston type expansion engine.

Figure 4:
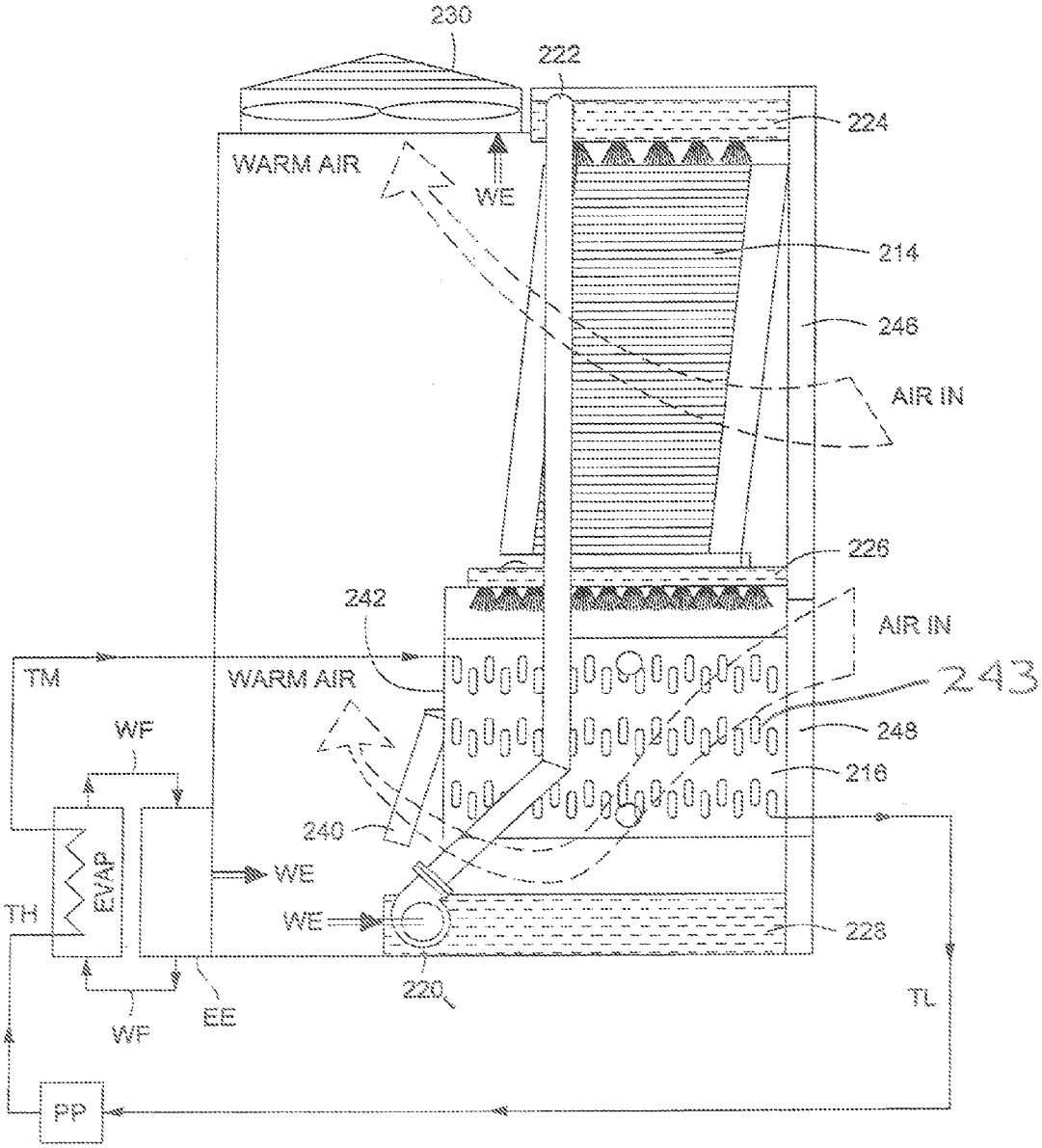
FIG. 4 is a diagram of an individual cooling tower utilized in conjunction with another embodiment.

FIG. 4 is a diagram of a hybrid type closed circuit cooling tower used with a heat engine. This example uses several system components that are disclosed in U.S. Pat. No. 7,062,913, which is hereby incorporated by reference in its entirety. For clarity, FIG. 3 of the present application utilizes components illustrated in FIG. 1 of U.S. Pat. No. 7,062,913. Reference numbers present in FIG. 1 of that patent have been modified by adding the number 1 in front of them such that the component labeled 14 in U.S. Pat. No. 7,062,913 is labeled as component 114 in FIG. 3 of the present application. Thus, these components can be, for example, substantially as described in U.S. Pat. No. 7,062,913 and their description is not repeated here due to the incorporation by reference.

A power plant PP generates hot fluid or steam at a high temperature TH which is supplied to an evaporator EVAP. This cools the process fluid to a medium temperature TM at which point it is supplied to coils 243. The process fluid is cooled in the coils 243 by the cooling tower processes and exits the coils 243 at a temperature TL where it is returned to the power plant PP. Working fluid is passed between the evaporator and the expansion engine EE. The expansion engine EE generates work energy WE which can be supplied to the pump 220 and/or the fan 230.

Figure 5:
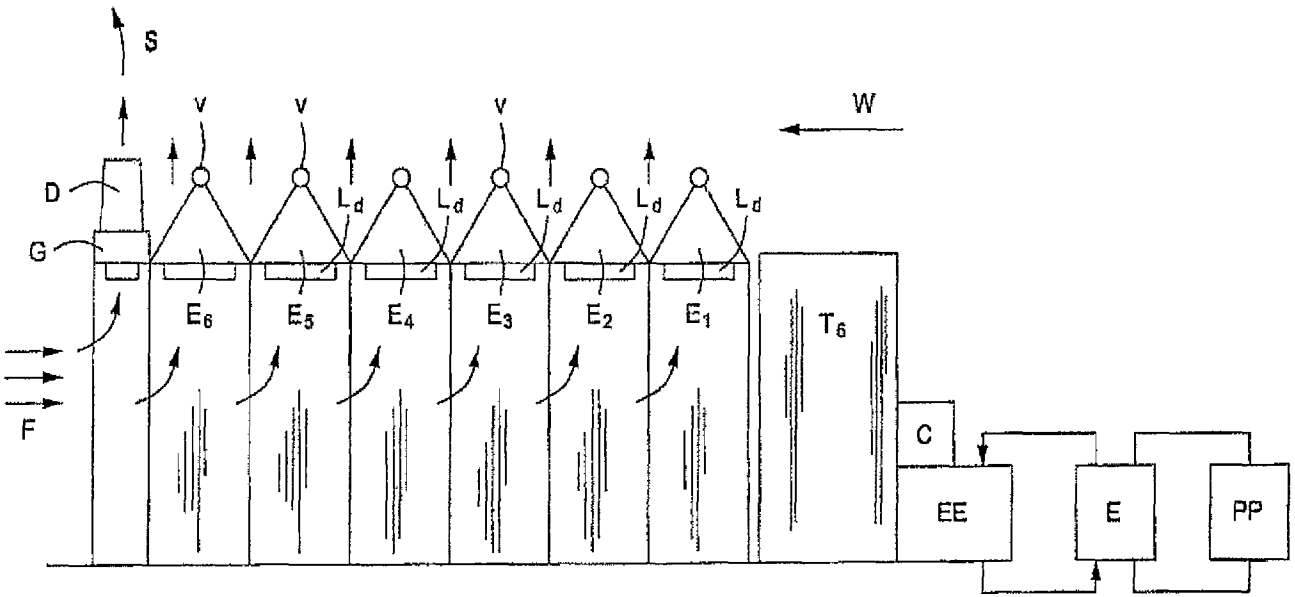
FIG. 5 is a diagram of yet another embodiment.

FIG. 5 depicts an embodiment where an expansion engine EE is utilized in conjunction with an air cooled condenser system. FIG. 4 is a diagram of a hybrid type closed circuit cooling tower used with a heat engine. This example uses several system components that are disclosed in U.S. Pat. No. 4,580,401, which is hereby incorporated by reference in its entirety. For clarity, FIG. 3 of the present application utilizes components illustrated in FIG. 1 of U.S. Pat. No. 4,580,401. Thus, these components can be, for example, substantially as described in U.S. Pat. No. 4,580,401 and their description is not repeated here due to the incorporation by reference. The system utilizes a condenser C, evaporator E, and power plant PP in similar conceptual fashion as the other embodiments.

More specifically, as can be seen in particular depicted in FIG. 5, each heat exchange element E is constructed in a roof-shaped manner of finned tubes; a steam distribution line V forms the ridge of the respective heat exchange element E. All of the ridges of the heat exchange elements E which are associated with a given turbine housing T are disposed parallel to one another as well as parallel to the front side of the turbine housing T. The heat exchange elements E associated with a given turbine housing T communicate via a main line with the turbine, which is not illustrated in the drawing. As a result, at the edge of the condenser system which extends parallel to the turbine housing T a concentrated air draft S is blown out, the flow velocity of which is greater than the outlet velocity of the cooling air from the heat exchange elements $E_2$ to $E_5$ which are located in the middle. The concentrated air draft S forms a sort of aerodynamic wall. As a result of this aerodynamic wall, even a cross wind W which is coming from the direction of the turbine housing T, as indicated, is deflected upwardly, so that even in this unfavorable situation of a strong cross wind, the exhaust air which is warmed up in the heat exchange elements $E_1$ to $E_6$ reached higher air layers. concentrated air draft S also can be produced at the free edge of the condenser system by separate air conduits which are disposed along the free edge of the condenser system and are provided with appropriate air outlet openings. These air conduits are supplied with air from, for example, a central blower.

The concentrated air draft S emerges from nozzles D which, in addition to effecting an additional acceleration of the air draft S, also effect the concentration thereof As illustrated, these nozzles D can be individual nozzles, each of which has associated therewith a fan L or a blower G.

Turning back to FIG. 4, the hybrid type closed circuit cooling tower is depicted in more detail. In particular, the fans 230 provide a pressure differential drawing air upward and out of the cooling tower. Thus, in the upper portion of the cooling tower, air is drawn into the air inlet 246 and passes across the upper fill media 214, before exiting the fill media 214 and being drawn upward and outward from the tower. The relatively warm cooling water which is pumped into the upper water distribution system 224, exits through nozzles and falls over the upper evaporative fill pack 214, is cooled by transportation therethrough, and is collected in the intermediate water distribution assembly 226.

The relatively cool cooling water after it is distributed by the intermediate water distribution assembly 226 passes over the lower heat exchanger 216, picking up heat and evaporatively exchanging heat to air while doing so, and falls into the lower collection basin 228, from which it is recirculated by the pump 220. The intermediate water distribution assembly 226 performs a further function of separating the two major air flows of the cooling tower. That is, the intermediate distribution assembly 226 separates the upper air flow, which is passing across the upper fill material 214 from the lower air flow which is passing over the lower heat exchanger 216. The lower heat exchanger 216 has at its air outlet side a side wall barrier or baffle 242, and a drift eliminator 240 disposed in the angled orientation generally depicted.

The above examples each illustrate a power plant that provides a hot fluid or steam and each illustrate all of the three loops being return loop systems. However, in some environments, it may be permissible or desirable to simply discharge the liquid which is exiting either the heat source loop or the cooling tower loop instead of recycling it.

A wide variety of cooling towers can be used with embodiments of the present invention, including types of cooling towers not illustrated in the Figures. Also, systems can be made utilizing package type cooling towers, and can be made to be mounted on a skid.

Figure 6:
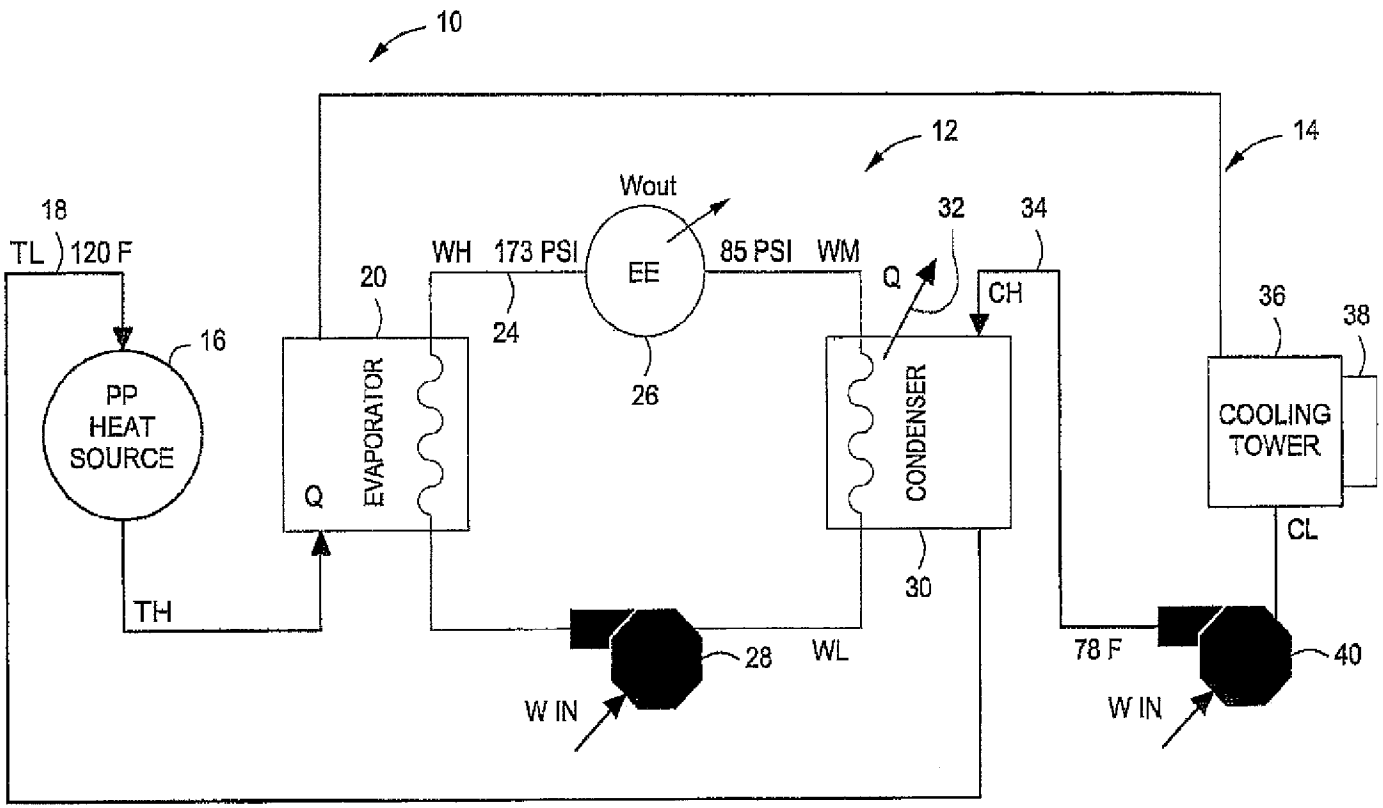
FIG. 6 is a diagram similar to FIG.2 but of a different alternative embodiment.

FIG. 6 is a diagram similar to FIG. 2 but of a different alternative embodiment. This embodiment uses two closed loops instead of the three loops of FIG. 1. One loop is working fluid between the evaporator and condenser, with the expansion engine EE located on the working fluid loop as shown, providing work to the working fluid loop and/or to the cooling tower loop. The cooling tower loop passes through the cooling tower, power plant PP, the evaporator and the condenser.

Figure 7:
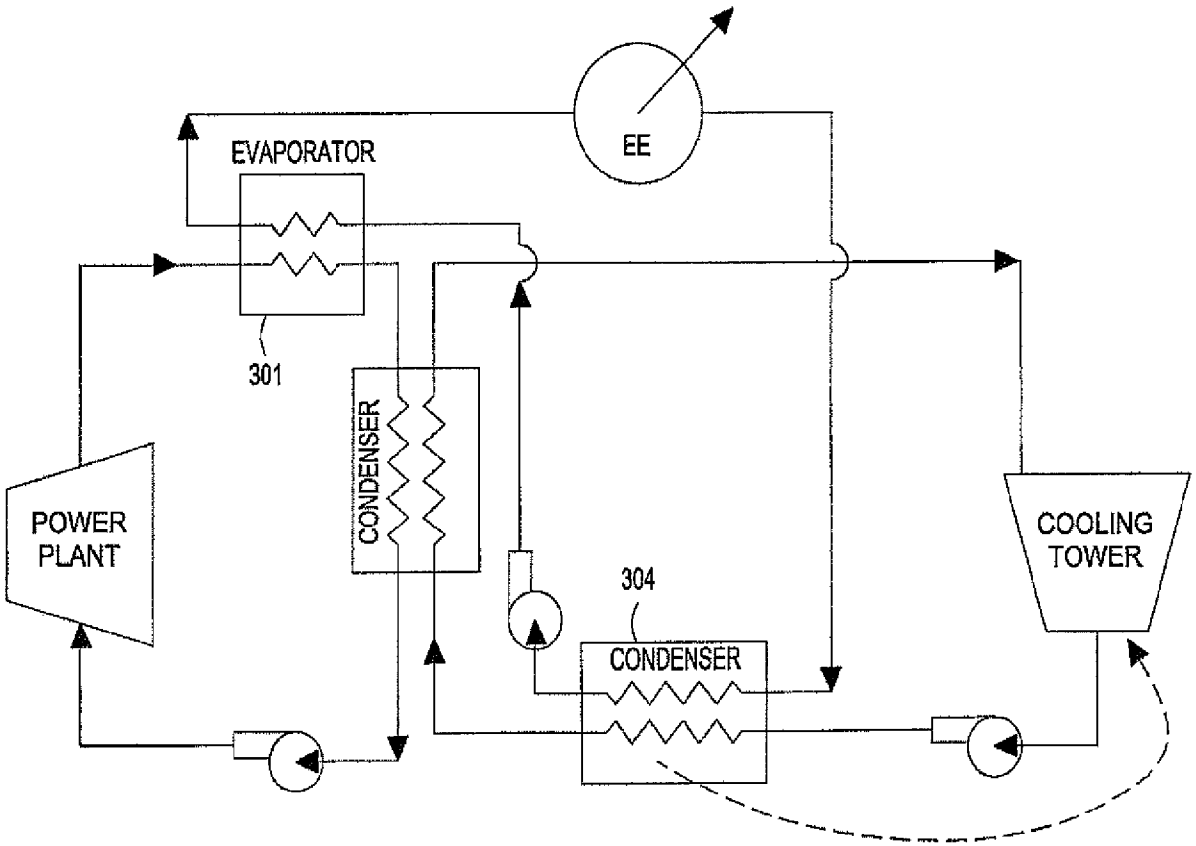
FIG. 7 is a diagram of another alternative embodiment.

FIG. 7 is a diagram of another alternative embodiment, utilizing three loops as shown. The evaporator 301 before the heat engine EE is in front of a main condenser 304 to tap the highest potential system temperature. If the system involves steam driving a turbine in the power plant PP, the temperature can be 200 degrees F. or higher. In the embodiment the condenser 304 can be located at the cold water basin of the cooling tower.

Figure 8:
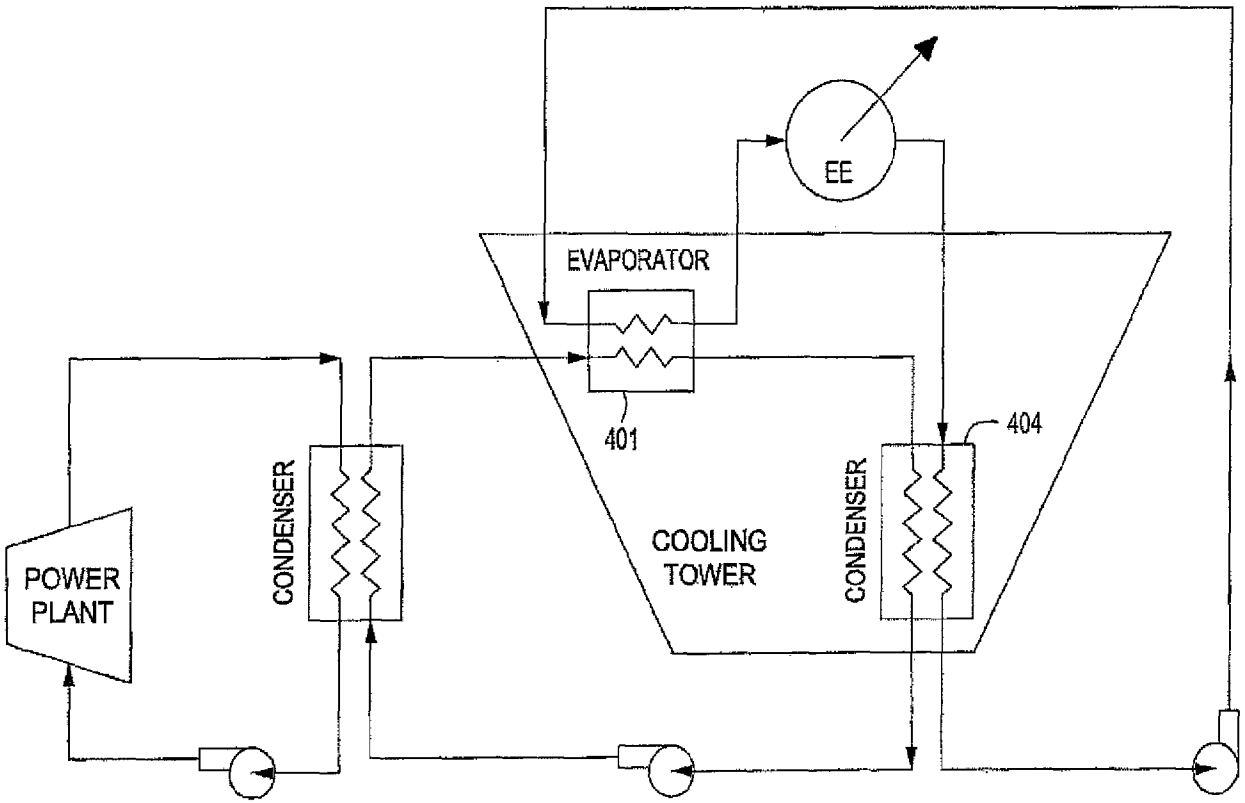
FIG. 8 is a diagram of another alternative embodiment.

FIG. 8 is a diagram of another alternative embodiment. In this embodiment, the heat engine evaporator 401 and the condenser 404 are integrated with the cooling tower, which arrangement may be easier to package in some applications. In the embodiment, the heat source for the evaporator is at a lower temperature than the embodiment of FIG. 7.

Figure 9:
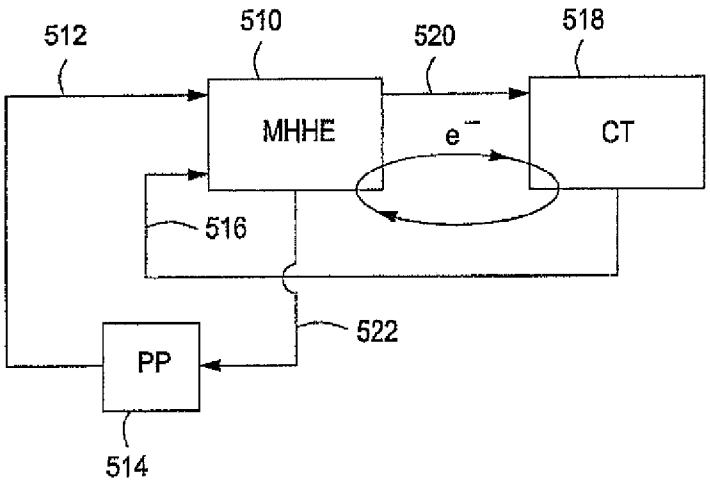
FIG. 9 is a diagram of another alternative embodiment.
Figure 10:
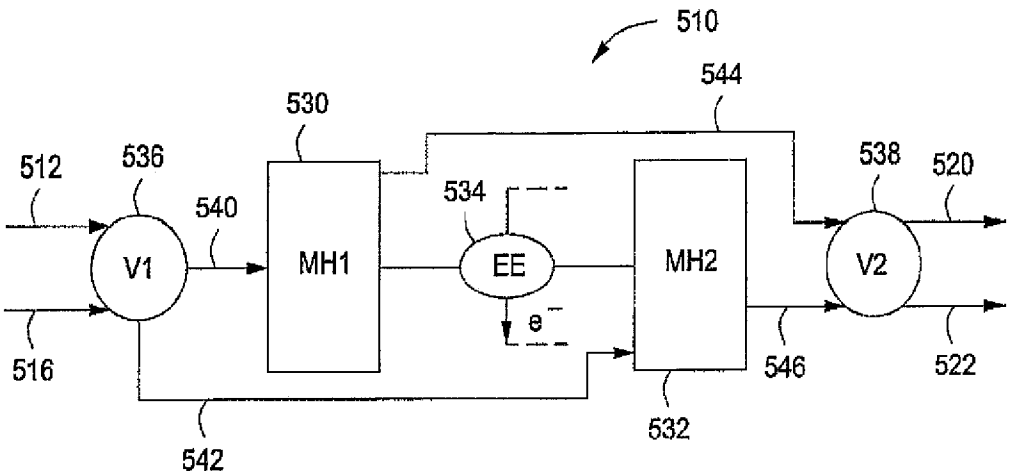
FIG. 10 is a diagram of another alternative embodiment.

Another heat engine that can be utilized in the present invention is a metal hydride heat engine. Compressors and pumps powered by hydrogen gas pressure differentials between metal hydrides at different temperatures are disclosed in Golben et al U.S. Pat. No. 4,402,187 and Golben U.S. Pat. No. 4,884,953 both of which are incorporated by reference. As shown in FIG. 9 of the present specification, a metal hydride expansion engine system 510 receives hot (or warm) fluid 512 (water or steam for example) from a power plant 514 and receives relatively cold (or cool) fluid 516 (water for example) from the cooling tower 518. The temperature difference between the fluids 512, 516 drives the engine system 510 and generates electricity to power at least some of the cooling tower equipment (for example a fan or pump). The hot fluid stream 520 exits the engine 510 and is supplied to the cooling tower 518. The cold fluid stream 522 exits the engine 510 and flows to the power plant 514. The hot and cold fluid streams 512, 516 may only be a fraction of the entire hot and cold fluid streams between the power plant and the cooling tower depending on how much electricity generation is desired. As shown in the FIG. 10, the metal hydride expansion engine system 510 may comprise a first metal hydride unit 530, a second metal hydride unit 532, an expansion engine electrical generator 534, a first valve device 536 and a second valve device 538. The first valve device 536 allows for switching of the hot fluid stream 512 between the first metal hydride unit 530 and the second metal hydride unit 532 via conduits 540 and 542, and allows for switching of the cold fluid stream 516 between the second metal hydride unit 532 and the first metal hydride unit 530 via conduits 542 and 540. While one metal hydride unit is in the presence of cold fluid the other metal hydride unit is in the presence of hot fluid thereby creating a pressure differential which allows hydrogen gas to flow between the metal hydride units and drive the expansion engine electrical generator to produce electricity to power cooling tower equipment such as a fan or a pump. Fluid exits the first metal hydride unit 530 via conduit 544 to second valve device 538 and exits the second metal hydride unit 532 via conduit 546 to second valve device 538. The second valve 538 allows for switching of flows from conduits 544, 546 to respective streams 520, 522 so that stream 522 remains the cold fluid stream and stream 520 remains the hot fluid stream. When the flow of hydrogen decreases between the metal hydride units then and power production decreases then the switching of the valves 536, 538 allows the hydrogen flow to be reversed between the metal hydride units 530, 532 and drives the expansion engine electrical generator 534.

The many features and advantages of the invention are apparent from the detailed specification, and thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and accordingly, all suitable modifications and equivalents may be resorted to, falling within the scope of the invention.

What is claimed is:

1. A method for operating a cooling tower system, the cooling tower system including a first fluid circuit containing a process fluid flowing therein, a second fluid circuit containing a working fluid flowing therein, a third fluid circuit containing a cooling fluid flowing therein, the third fluid circuit being in fluid communication with a cooling tower unit having a component that requires power for operation thereof, a first heat exchanger in fluid communication with the first fluid circuit and the third fluid circuit, and a second heat exchanger in fluid communication with the second fluid circuit and the third fluid circuit, the method comprising:

transferring heat from a heat source of the first fluid circuit into the process fluid;

transferring heat from the first fluid circuit into the third fluid circuit via the first heat exchanger;

extracting power from the working fluid by expanding the working fluid through a waste heat expansion engine disposed within the second fluid circuit;

transferring heat from the second fluid circuit into the third fluid circuit via the second heat exchanger disposed downstream of the waste heat expansion engine in a direction of working fluid flow;

transferring heat from the cooling fluid to an ambient environment via an airflow through the cooling tower unit; and transferring at least a portion of the power extracted from the working fluid by the waste heat expansion engine to the component of the cooling tower unit.

2. The method of claim 1, the cooling tower system further including a third heat exchanger in fluid communication with both the first fluid circuit and the second fluid circuit, the method further comprising transferring heat from the first fluid circuit into the second fluid circuit via the third heat exchanger, wherein the third heat exchanger is disposed downstream of the heat source and upstream of the first heat exchanger in a direction of process fluid flow, and wherein the third heat exchanger is disposed downstream of the second heat exchanger and upstream of the waste heat expansion engine in a direction of working fluid flow.

3. The method of claim 1, the cooling tower system further including a third heat exchanger in fluid communication with both the second fluid circuit and the third fluid circuit, the method further comprising transferring heat from the third fluid circuit into the second fluid circuit via the third heat exchanger, wherein the third heat exchanger is disposed downstream of the first heat exchanger and upstream of the second heat exchanger in a direction of cooling fluid flow, and wherein the third heat exchanger is disposed downstream of the second heat exchanger and upstream of the waste heat expansion engine in a direction of working fluid flow.

4. The method of claim 1, wherein the waste heat expansion engine is a piston engine.

5. The method of claim 1, wherein the waste heat expansion engine is a metal hydride engine.

6. The method of claim 1, wherein the cooling tower unit is an air cooled condenser.

7. The method of claim 1, further comprising returning the process fluid to the heat source.

8. A method for operating a cooling tower system, the cooling tower system including a first fluid circuit containing a process fluid flowing therein, a second fluid circuit containing a working fluid flowing therein, a third fluid circuit containing a cooling fluid flowing therein, the third fluid circuit being in fluid communication with a cooling tower unit having a component that requires power for operation thereof, means for exchanging heat in fluid communication with the first fluid circuit and the third fluid circuit, and second means for exchanging heat in fluid communication with the second fluid circuit and the third fluid circuit, the method comprising:

transferring heat from means for generating heat of the first fluid circuit into the process fluid;

transferring heat from the first fluid circuit into the third fluid circuit via the first means for exchanging heat;

extracting power from the working fluid by expanding the working fluid through means for converting heat into power disposed within the second fluid circuit;

transferring heat from the second fluid circuit into the third fluid circuit via the second means for exchanging heat disposed downstream of the means for converting heat into power;

transferring heat from the third fluid circuit to an ambient environment via a flow of ambient air through the cooling tower unit; and transferring at least a portion of the power extracted from the working fluid by the means for converting heat into power to the component of the cooling tower unit.

9. A method for operating a cooling tower system, the cooling tower system including a first fluid circuit containing a process fluid flowing therein, the first fluid circuit being in fluid communication with a cooling tower unit having a component that requires power for operation thereof, a second fluid circuit containing a working fluid flowing therein, a first heat exchanger in fluid communication with the first fluid circuit and the second fluid circuit, a third fluid circuit containing a cooling fluid flowing therein, and a second heat exchanger in fluid communication with the second fluid circuit and the third fluid circuit, the method comprising:

transferring heat from a heat source of the first fluid circuit into the process fluid;

transferring heat from the first fluid circuit into the second fluid circuit via the first heat exchanger;

extracting power from the working fluid by expanding the working fluid through a waste heat expansion engine disposed within the second fluid circuit;

transferring heat from the first fluid circuit to an ambient environment via a flow of ambient air through the cooling tower unit;

transferring at least a portion of the power extracted from the working fluid by the waste heat expansion engine to the component of the cooling tower unit; and transferring heat from the second fluid circuit into the third fluid circuit via the second heat exchanger, wherein the second heat exchanger is disposed downstream of the waste heat expansion engine and upstream of the first heat exchanger in a direction of working fluid flow.

10. The method of claim 9, wherein the heat source is a power plant, and the process fluid exiting the power plant is low pressure steam.

11. The method of claim 9, wherein the waste heat expansion engine is an organic Rankine cycle engine.

12. The method of claim 9, wherein the component of the cooling tower unit is a fan.

13. The method of claim 9, wherein the power extracted from the working fluid by the waste heat expansion engine is transferred to the component of the cooling tower unit in the form of electricity.

14. The method of claim 9, wherein the power extracted from the working fluid by the waste heat expansion engine is transferred to the component of the cooling tower unit in the form of a rotational torque.

15. The method of claim 9, wherein the waste heat expansion engine receives the working fluid as a liquid for vaporization.

16. The method of claim 9, wherein the waste heat expansion engine is a piston engine.

17. The method of claim 9, wherein the process fluid exiting the heat source is steam.

18. The method of claim 9, wherein the cooling tower unit is an air cooled condenser.

19. The method of claim 9, further comprising returning the process fluid to the heat source.

20. The method of claim 9, wherein the waste heat expansion engine is a metal hydride engine.

21. The method of claim 9, further comprising transferring heat from the third fluid circuit into the airflow via the cooling tower unit.

22. The method of claim 9, wherein the cooling tower system further includes a second heat exchanger in fluid communication with the first fluid circuit and the second fluid circuit, the method further comprising:

transferring heat from the second fluid circuit into the first fluid circuit via the second heat exchanger, wherein the first heat exchanger is disposed downstream of the heat source and upstream of the cooling tower unit in a direction of process fluid flow, wherein the second heat exchanger is disposed downstream of the cooling tower and upstream of the heat source in the direction of process fluid flow, and wherein the second heat exchanger is disposed downstream of the waste heat expansion engine in a direction of working fluid flow.

23. A method for operating a cooling tower system, the cooling tower system including a first fluid circuit containing a process fluid flowing therein, the first fluid circuit being in fluid communication with a cooling tower unit having a component that requires power for operation thereof, a second fluid circuit containing a working fluid flowing therein, first means for exchanging heat in fluid communication with the first fluid circuit and the second fluid circuit a third fluid circuit containing a cooling fluid flowing therein, and second means for exchanging heat in fluid communication with the second fluid circuit and the third fluid circuit, the method comprising:

transferring heat from means for generating heat of the first fluid circuit into the process fluid;

transferring heat from the first fluid circuit into the second fluid circuit via the first means for exchanging heat;

extracting power from the working fluid by expanding the working fluid through means for converting heat into power disposed within the second fluid circuit;

transferring heat from the first fluid circuit to an ambient environment via a flow of ambient air through the cooling tower unit;

transferring at least a portion of the power extracted from the working fluid by the means for converting heat into power to the component of the cooling tower unit; and transferring heat from the second fluid circuit into the third fluid circuit via the second means for exchanging heat, wherein the second means for exchanging heat is disposed downstream of the means for converting heat into power and upstream of the first means for exchanging heat in a direction of working fluid flow.

24. A cooling tower system, comprising:

a first fluid circuit containing a process fluid flowing therein, the first fluid circuit including a heat source in fluid communication with the process fluid;

a second fluid circuit containing a working fluid flowing therein, the second fluid circuit including a waste heat expansion engine in fluid communication with the working fluid;

a third fluid circuit containing a cooling fluid flowing therein, the third fluid circuit including a cooling tower unit in fluid communication with the cooling fluid and a flow of ambient air, the cooling tower unit being configured to transfer heat from the process fluid to the flow of ambient air, the cooling tower unit having a component that requires power for operation thereof;

a first heat exchanger in fluid communication with both the first fluid circuit and the third fluid circuit, thereby effecting thermal communication therebetween; and a second heat exchanger in fluid communication with both the second fluid circuit and the third fluid circuit, thereby effecting thermal communication therebetween, wherein the waste heat expansion engine is configured to extract power from the working fluid flowing therethrough and transfer at least a portion of the power to the component of the cooling tower unit.

25. The system of claim 24, further comprising a third heat exchanger in fluid communication with second fluid circuit upstream of the waste heat expansion engine and downstream of the second heat exchanger in a direction of working fluid flow.

26. The system of claim 25, wherein the third heat exchanger is also in fluid communication with the first fluid circuit downstream of the heat source and upstream of the first heat exchanger in a direction of process fluid flow, thereby effecting thermal communication between the first fluid circuit and the second fluid circuit.

27. The system of claim 25, wherein the third heat exchanger is also in fluid communication with the third fluid circuit downstream of the first heat exchanger and upstream of the second heat exchanger in a direction of cooling fluid flow.

28. The system of claim 24, wherein the heat source is a power plant, and the process fluid exiting the power plant is low pressure steam.

29. The system of claim 24, wherein the waste heat expansion engine is an organic Rankine cycle engine.

30. The system of claim 24, wherein the waste heat expansion engine is a piston engine.

31. The system of claim 24, wherein the component of the cooling tower unit is a fan.

32. The system of claim 24, wherein the waste heat expansion engine is a metal hydride engine.

33. A cooling tower system, comprising:

a first fluid circuit containing a process fluid flowing therein, the first fluid circuit including means for generating heat in fluid communication with the process fluid;

a second fluid circuit containing a working fluid flowing therein, the second fluid circuit including means for converting heat into power in fluid communication with the working fluid;

a third fluid circuit containing a cooling fluid flowing therein, the third fluid circuit including a cooling tower unit in fluid communication with the cooling fluid and a flow of ambient air, the cooling tower unit being configured to transfer heat from the cooling fluid to the flow of ambient air, the cooling tower unit having a component that requires power for operation thereof;

first means for exchanging heat in fluid communication with both the first fluid circuit and the third fluid circuit, thereby effecting thermal communication therebetween; and second means for exchanging heat in fluid communication with both the second fluid circuit and the third fluid circuit, thereby effecting thermal communication therebetween, wherein the means for converting heat into power is configured to extract power from the working fluid flowing therethrough and transfer at least a portion of the power to the component of the cooling tower unit.

34. A cooling tower system, comprising:

a first heat exchanger;

a first fluid circuit containing a process fluid flowing therein, the first heat exchanger receiving the process fluid from the first fluid circuit, the first fluid circuit including a heat source in fluid communication with the process fluid, the heat source disposed upstream of the first heat exchanger in a direction of process fluid flow, and a cooling tower unit in fluid communication with the process fluid and a flow of ambient air, the cooling tower unit being configured to transfer heat from the process fluid to the flow of ambient air, the cooling tower unit disposed downstream of the first heat exchanger in the direction of process fluid flow, the cooling tower unit including a component that requires power for operation thereof;

a second fluid circuit containing a working fluid flowing therein, the first heat exchanger also receiving the working fluid from the second fluid circuit, thereby effecting thermal communication between the first fluid circuit and the second fluid circuit, the second fluid circuit including a waste heat expansion engine in fluid communication with the working fluid, the waste heat expansion engine disposed downstream of the first heat exchanger in a direction of working fluid flow;

a second heat exchanger that receives working fluid from the second fluid circuit downstream of the waste heat expansion engine and upstream of the first heat exchanger in the direction of working fluid flow; and a third fluid circuit containing a cooling fluid flowing therein, the second heat exchanger also receiving cooling fluid from the third fluid circuit, thereby effecting thermal communication between the second fluid circuit and the third fluid circuit, wherein the waste heat expansion engine is configured to extract power from the working fluid flowing therethrough and transfer at least a portion of the power to the component of the cooling tower unit.

35. The system of claim 34, wherein the heat source is a power plant, and the process fluid exiting the power plant is low pressure steam.

36. The system of claim 34, wherein the waste heat expansion engine is an organic Rankine cycle engine.

37. The system of claim 34, wherein the waste heat expansion engine is a piston engine.

38. The system of claim 34, wherein the component of the cooling tower unit is a fan.

39. The system of claim 34, wherein the waste heat expansion engine is a metal hydride engine.

40. The cooling tower system of claim 34, wherein the third fluid circuit is in fluid communication with the cooling tower unit.

41. The cooling tower system of claim 34, wherein the second heat exchanger also receives process fluid from the first fluid circuit downstream of the cooling tower unit and upstream of the heat source in the direction of process fluid flow, thereby effecting further thermal communication between the first fluid circuit and the second fluid circuit.

42. A cooling tower system, comprising:

first means for exchanging heat;

a first fluid circuit containing a process fluid flowing therein, the first means for exchanging heat receiving the process fluid from the first fluid circuit, the first fluid circuit including means for generating heat in fluid communication with the process fluid, the means for generating heat disposed upstream of the first means for exchanging heat in a direction of process fluid flow, and a cooling tower unit in fluid communication with the process fluid and a flow of ambient air, the cooling tower unit being configured to transfer heat from the process fluid to the flow of ambient air, the cooling tower unit disposed downstream of the first means for exchanging heat in the direction of process fluid flow, the cooling tower unit including a component that requires power for operation thereof; and a second fluid circuit containing a working fluid flowing therein, the first means for exchanging heat also receiving the working fluid from the second fluid circuit, thereby effecting thermal communication between the first fluid circuit and the second fluid circuit, the second fluid circuit including means for converting heat into power in fluid communication with the working fluid, the means for converting heat into power disposed downstream of the first means for exchanging heat in a direction of working fluid flow;

second means for exchanging heat that receives working fluid from the second fluid circuit downstream of the means for converting heat into power and upstream of the first means for exchanging heat in the direction of working fluid flow; and a third fluid circuit containing a cooling fluid flowing therein, the second means for exchanging heat also receiving cooling fluid from the third fluid circuit, thereby effecting thermal communication between the second fluid circuit and the third fluid circuit, wherein the means for converting heat into power is configured to extract power from the working fluid flowing therethrough and transfer at least a portion of the power to the component of the cooling tower unit.

* * * * *